US008113823B2

(12) United States Patent
Guzorek

(10) Patent No.: US 8,113,823 B2
(45) Date of Patent: Feb. 14, 2012

(54) APPARATUS AND METHOD FOR CONTROLLING A DAMPER IN A GAS-FIRED APPLIANCE

(75) Inventor: Steven E. Guzorek, Kinston, NC (US)

(73) Assignee: Field Controls, LLC, Kinston, NC (US)

( * ) Notice: Subject to any disclaimer, the term of this patent is extended or adjusted under 35 U.S.C. 154(b) by 833 days.

(21) Appl. No.: 12/011,944

(22) Filed: Jan. 29, 2008

(65) Prior Publication Data

US 2009/0191495 A1 Jul. 30, 2009

(51) Int. Cl.

| | |
|---|---|
| ***F23N 3/00*** | (2006.01) |
| ***F23N 1/02*** | (2006.01) |
| ***F23L 11/00*** | (2006.01) |
| ***H01H 3/16*** | (2006.01) |
| ***H01H 25/00*** | (2006.01) |
| ***F24F 7/00*** | (2006.01) |

(52) U.S. Cl. ..... 431/20; 431/12; 431/19; 126/285 R; 307/119; 200/61.58 R; 200/337; 454/358

(58) Field of Classification Search ..... 431/20, 431/12, 19; 126/285 R; 307/119, 112; 200/117 R, 200/47, 61.58 R, 61.62, 573, 574, 337; 454/358
See application file for complete search history.

(56) References Cited

U.S. PATENT DOCUMENTS

| | | | | |
|---|---|---|---|---|
| 4,087,045 | A * | 5/1978 | Matthews | 236/1 G |
| 4,131,413 | A * | 12/1978 | Ryno | 431/44 |
| 4,416,611 | A * | 11/1983 | Zivny | 431/20 |
| 4,778,378 | A | 10/1988 | Dolnick et al. | |
| 5,447,125 | A | 9/1995 | McNally et al. | |
| 6,053,163 | A | 4/2000 | Bass | |
| 6,257,871 | B1 | 7/2001 | Weiss et al. | |
| 6,261,087 | B1 | 7/2001 | Bird et al. | |
| 6,354,934 | B1 * | 3/2002 | Seuge | 454/69 |
| 6,378,516 | B1 * | 4/2002 | Blount | 126/512 |
| 6,439,877 | B1 | 8/2002 | Weiss | |
| 6,644,957 | B2 | 11/2003 | Weiss | |
| 6,749,124 | B2 | 6/2004 | Weiss | |
| 2004/0176859 | A1 | 9/2004 | Chian et al. | |
| 2005/0066958 | A1 * | 3/2005 | Guzorek | 126/285 R |
| 2005/0247304 | A1 | 11/2005 | Weiss | |

* cited by examiner

*Primary Examiner* — Kenneth Rinehart
*Assistant Examiner* — William Corboy
(74) *Attorney, Agent, or Firm* — Wood, Phillips, Katz, Clark & Mortimer

(57) ABSTRACT

A damper mechanism for a gas-fired appliance is disclosed. The damper mechanism is mechanically operated in response to changes in pressure within a portion of the appliance. Changes in gas pressure operate to displace a diaphragm, thereby moving a linkage attached to a flue damper, such that the damper can be moved between open and closed positions. An interim damper control activation arm can pivot in response to movement of the linkage to actuate electrical switches, which act to close a magnetic pilot valve when the damper is in a partially-opened or partially-closed position.

21 Claims, 4 Drawing Sheets

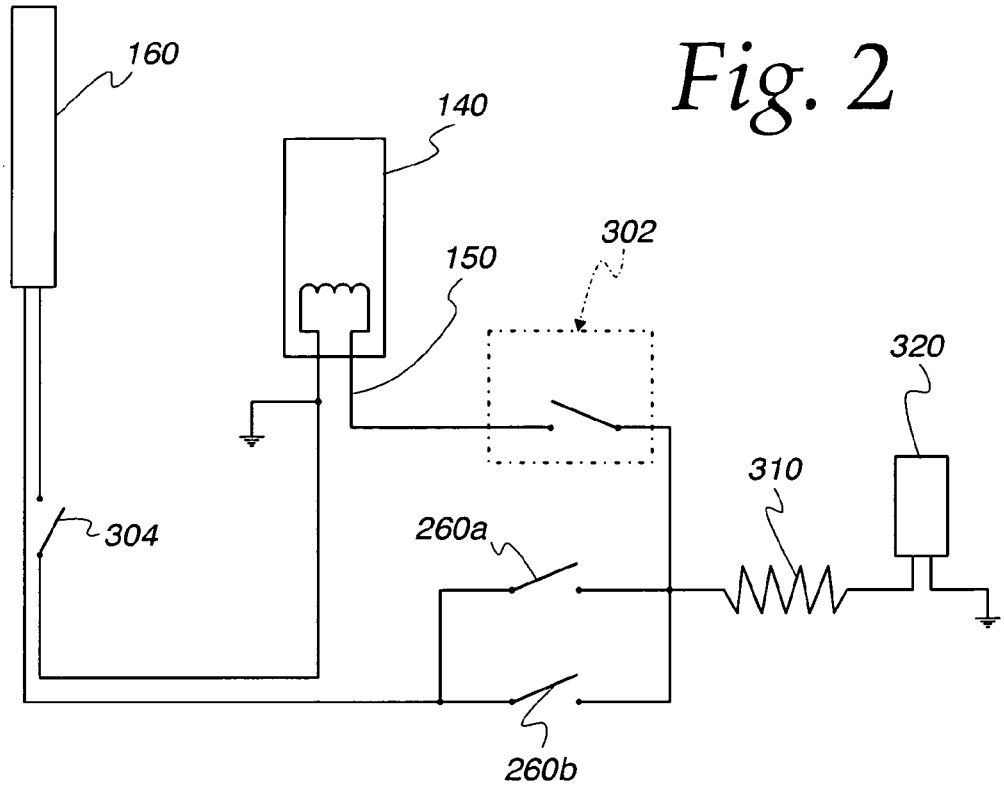
Fig. 2
Fig. 3
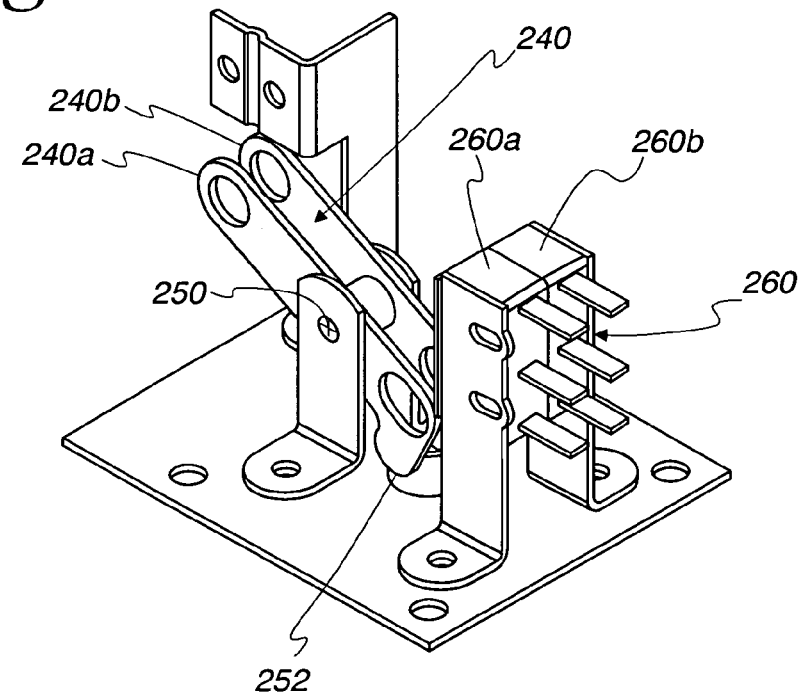

APPARATUS AND METHOD FOR CONTROLLING A DAMPER IN A GAS-FIRED APPLIANCE

TECHNICAL FIELD

The present invention relates generally to gas-fired appliances, and, more particularly, to a damper control mechanism for a water heater or other gas-fired appliance.

BACKGROUND OF THE INVENTION

Many gas-fired appliances, such as boilers or water heaters, include burners that fire to raise the temperature of materials, such as water, contained within a tank. In many such appliances, the burners periodically cycle on and off. When the contents of the tank fall below a desired minimum temperature, a call for heat is triggered, which initiates the firing of a main gas burner assembly. The resulting heat generated by the burner acts to raise the tank temperature. When the tank temperature reaches a desired maximum threshold, the main burner is deactivated, until such time as the tank cools and again falls below the minimum desired temperature. A small pilot burner can be provided to maintain a small flame under normal operation, which flame is used to ignite the main burner when desired.

To increase the energy efficiency of such gas-fired appliances, many systems include one or more dampers. For example, a flue damper can be provided within an exhaust flue near the top of a gas fired appliance. The flue damper is opened during operation of the main burner, to permit the venting of heat and exhaust gases generated during operation of the main burner. However, once the main burner is shut off, the flue damper closes the flue, thereby reducing heat loss out the flue and retaining heat within the appliance to improve the overall energy efficiency of the appliance.

Conventionally, dampers can be operated using an electric motor supplied by 24 volt or 120 volt power sources. However, such designs typically require the routing of a power source to the location of the gas-fired appliance, potentially increasing installation costs. More recently, gas fired appliances have been designed using thermoelectric devices such as one or more 750 millivolt thermopiles, operating using heat from the pilot flame, to power a low-power motor. The low-power motor in turn operates the flue damper.

However, many gas-fired appliances, particularly residential water heaters, do not include power sources having sufficient voltage to reliably operate a damper motor. As a result, many residential water heaters are primarily mechanically operated. While some such water heaters may utilize a thermocouple to operate a magnetic pilot safety switch, such thermocouples typically generate only 10 to 30 millivolts, and do not supply sufficient power to drive a damper motor. Because of such control limitations, flue dampers are often not provided on residential water heaters, thereby sacrificing potential improvements in energy efficiency.

SUMMARY OF THE INVENTION

In accordance with one exemplary form of the invention, a gas-fired appliance is provided, having a burner which is configured to receive and burn pressurized gas, such as natural gas, during operation. A diaphragm device includes an inlet which is exposed to the gas pressure during operation of the burner. The diaphragm device also includes a moveable member, such as a flexible diaphragm exposed to ambient pressure on one side and the pressure of the pressurized gas on the other, such that it moves in response to the application of pressurized gas at the diaphragm device inlet. A linkage, which may be directly or indirectly connected to the diaphragm device, moves in response to movement of the moveable member. In some embodiments, the linkage may be comprised of a metal cable sliding within a stationary sheath, or a shaft. The linkage is connected to a damper assembly, which includes a damper that is movable between open and closed positions in response to movement of the linkage. The damper assembly may also include a rotatable damper shaft on which the damper is mounted, and a lever arm secured to the rotatable damper shaft at a first location and secured to the linkage at a second location.

In accordance with some embodiments, the gas-fired appliance further includes a pilot burner, and a thermoelectric device, such as a thermocouple or thermopile, positioned near the pilot burner, such that the thermoelectric device generates an electrical voltage differential when exposed to heat from the pilot burner. A magnetic pilot valve controls gas flow to the pilot burner, and features an electrical input. The magnetic pilot valve is maintained in an open position in response to the maintenance of the voltage generated by the pilot flame. A switch circuit is interposed in an electrical conduction path between the thermoelectric device and the magnetic pilot valve electrical input, whereby it can operate to control the transmission of the electrical voltage differential generated by the thermoelectric device to the magnetic pilot valve electrical input. The switch circuit is movable between an open state and a closed state in response to movement of the linkage. Accordingly, if the linkage becomes resident in an intermediate state, corresponding to a partially-opened or partially-closed damper position, the switch circuit can be configured to assume an open state, thereby cutting off the application of electrical voltage to the magnetic pilot valve and thus stopping the supply of gas to the pilot burner.

The linkage may include a damper control activation arm, which pivots between a first position and a second position in response to movement of the linkage. In some embodiments, the damper control activation arm moves throughout a predetermined range of motion, in which the first position comprises a range from zero to about 20 percent of the predetermined range of motion, and the second position comprises a range from about 80 percent to 100 percent of the predetermined range of motion.

The damper control activation arm can interact with the switch circuit to control the state thereof. For example, the switch circuit can include a first switch and a second switch, electrically connected in parallel. The first switch is closed by the damper control activation arm when the damper control activation arm is in the first position, while the second switch is closed when the damper control activation arm is in the second position. Accordingly, the switch circuit can operate to provide a closed electrical path when the damper control activation arm is in either the first position or the second position.

In such an embodiment, additional components can be provided to maintain an electrical voltage differential at the magnetic pilot valve input for a period of time when the damper control activation arm transitions between the first and second positions. Such components may include a resistor and a capacitor, whereby the capacitor is connected between a signal path leading to the pilot valve electrical input and a ground reference voltage. Accordingly, the capacitor can become charged by the electrical voltage differential provided by the thermoelectric device when the switch circuit is in a closed state, and the capacitor can discharge to provide an electrical voltage differential to the magnetic pilot valve switch when the switch circuit is in an open state.

The damper control activation arm can include a first arm portion and a second arm portion. The first arm portion depresses a contact on the first switch when the damper control activation arm is in the first position. The second arm portion depresses a contact on the second switch when the damper control activation arm is in the second position.

A damper control mechanism for an appliance that operates through combustion of gas having a pressure greater than ambient pressure is also provided. The control mechanism includes a diaphragm device having an inlet that is exposed to the gas pressure during operation of the appliance. The diaphragm device further includes a moveable diaphragm having a first side and a second side. The moveable diaphragm is exposed to pressure conditions of the inlet on the first side, and ambient pressure conditions on the second side. Accordingly, the moveable diaphragm moves in response to change of pressure at the inlet. The moveable diaphragm occupies a first position when the inlet is under ambient pressure conditions, and a second position when the inlet is exposed to the gas pressure. The damper control mechanism also includes a linkage which is operably connected to the diaphragm device and the damper, whereby the linkage imparts movement on the damper in response to movement of the moveable diaphragm.

The damper control mechanism may also include a thermoelectric device having an output capable of generating an electrical voltage differential. A circuit which includes one or more electrical switches electrically connects the thermoelectric device and a magnetic pilot valve. The linkage contacts the one or more electrical switches to disconnect the thermoelectric device from the magnetic pilot valve when the movable diaphragm is not within either the first or the second position. A capacitor can be provided, having a first term terminal electrically connected with the thermoelectric device and the magnetic pilot valve, and a second terminal connected to a ground reference voltage. Accordingly, if, for example, the one or more switches are placed into an open position to disconnect the capacitor from the thermoelectric device, the capacitor can temporarily apply an electrical voltage differential to the magnetic pilot valve.

The linkage may include an arm attached to a pivot, such that the arm pivots between a first position and a second position during movement of the linkage. The arm can be mounted proximate the one or more electrical switches, such that it contacts the switches to change their state during movement of the arm.

A method for controlling a damper in a gas-fired appliance is also provided. The method includes the steps of applying pressurized gas to a first portion of the gas-fired appliance which includes a main burner. The method further includes the step of opening a damper by moving a linkage connected to the damper via an application of mechanical force generated by the introduction of pressurized gas into the first portion of the gas-fired appliance. The step of applying pressurized gas to a first portion of the gas-fired appliance may include the step of applying pressurized gas to a diaphragm device to cause movement of said diaphragm device. The step of opening a damper by moving a linkage may include the step of moving the linkage in response to said movement of the diaphragm device.

In other embodiments, the step of opening a damper via movement of the linkage can include the steps of: providing a magnetic pilot valve which maintains an open position in response to the maintenance of an electrical signal at an input terminal; applying the electrical signal to the magnetic pilot valve input terminal when the damper is in an open or closed position; and removing the electrical signal from the magnetic pilot valve input terminal when the damper occupies a partially-opened position for at least a predetermined period of time. The predetermined period of time can be zero or greater. In some embodiments, the predetermined period of time is at least about 2 seconds. In other embodiments, the predetermined period of time is between about two seconds and about three seconds.

BRIEF DESCRIPTION OF THE DRAWINGS

FIG. 2 is a schematic block diagram of a flue damper control circuit.

FIG. 3 is a perspective view of a pilot power control switch.

DETAILED DESCRIPTION

Figure 1:
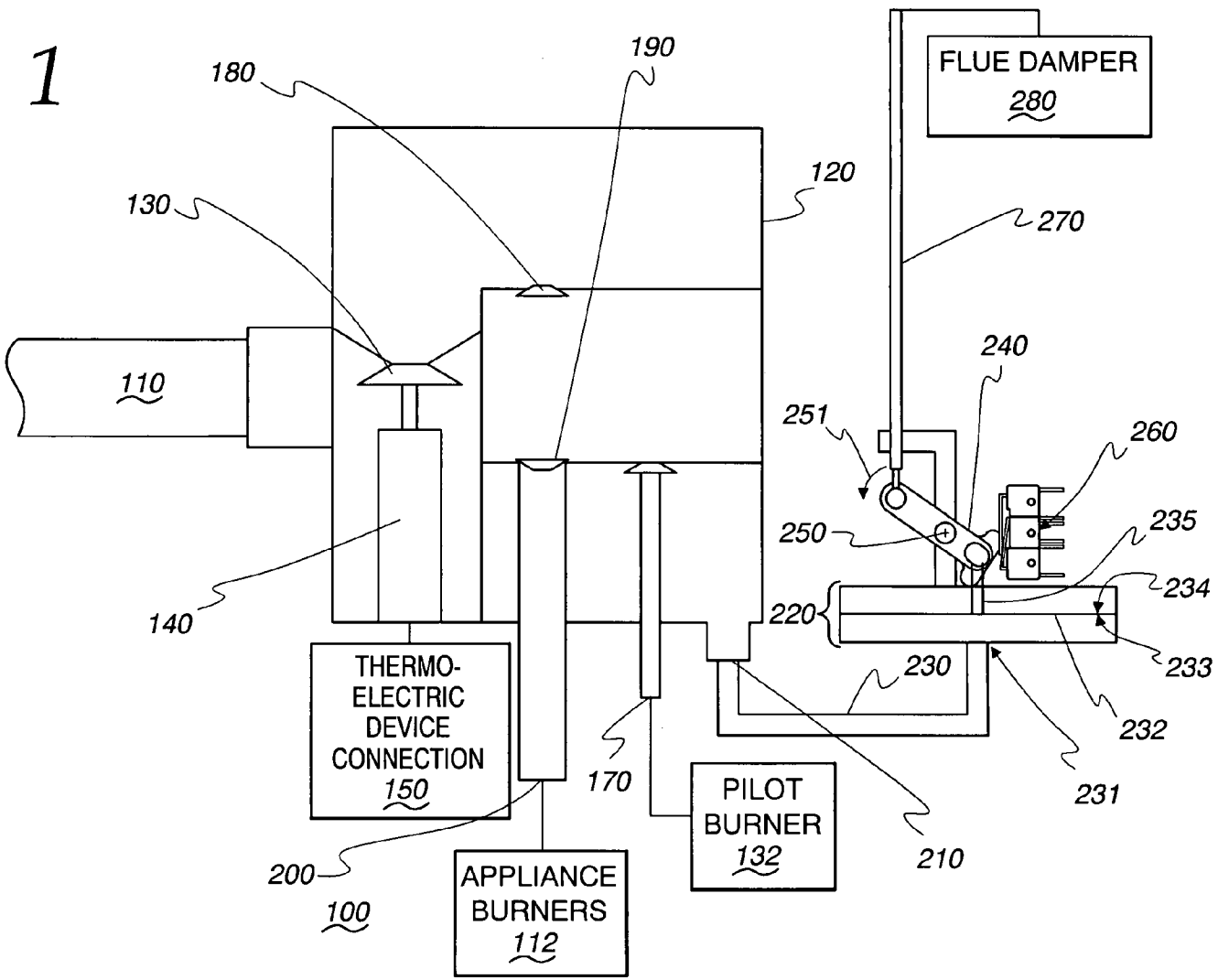
FIG. 1 is a diagrammatic view of a portion of a gas-fired appliance, having a manually-operated damper and pilot power control switch, in accordance with one embodiment of the invention.

While this invention is susceptible of embodiment in many different forms, there are shown in the drawings and will herein be described in detail, certain specific embodiments with the understanding that the present disclosure should be considered as an exemplification of the principles of the invention and is not intended to limit the invention to the embodiments so illustrated or described.

Referring initially to FIG. 1, a portion of a gas-fired appliance, such as a water heater, is illustrated. Gas fired appliance 100 receives combustible gas, such as natural gas, via supply line 110. The gas is supplied at a pressure greater than the ambient air pressure in which the main appliance burners 112 (shown schematically) operate. Gas is fed into control body 120 and through pilot valve 130, which supplies gas to a pilot burner 132 (shown schematically). Once pilot burner 132 is ignited, pilot valve 130 is maintained in an open position by pilot valve magnet 140, which is energized by voltage received at thermoelectric device connection 150. Thermoelectric device connection 150 is energized by thermoelectric device 160 (illustrated in FIG. 2). In exemplary embodiments, thermoelectric device 160 may include a thermocouple or a thermopile. Thermoelectric device 160 is positioned adjacent pilot burner 132 to generate voltage when exposed to the heat of the pilot flame. If the pilot flame is extinguished, thermoelectric device 160 ceases generation of sufficient voltage for pilot valve magnet 140 to maintain pilot valve 130 in an open position, thereby stopping the flow of gas to pilot burner 132 via supply tube 170 and preventing unintentional flooding of unburned gas.

Control body 120 further includes gas pressure regulator 180, which operates to regulate the gas pressure within control body 120. Temperature controlled burner valve 190 operates to limit the conditions under which gas is supplied to primary appliance burners 112 via burner supply tube 200. For example, in an embodiment in which gas fired appliance 100 is a water heater, a temperature sensor can be provided within the water tank, such that a call for heat is issued when the water temperature falls below a desired level. In response to a call for heat, burner valve 190 is opened, thereby supplying gas to main burner 112 through burner supply tube 200. When burner 112 acts to raise the monitored temperature above a desired maximum level, burner valve 190 is closed, thereby shutting off the flow of gas to burner 112.

In addition to providing gas feeds to pilot burner supply tube 170 and main burner supply tube 200, control body 120 further includes a gas pressure tap port 210. Gas pressure tap port 210 is connected to a diaphragm device 220 via tube 230 to communicate pressure within control body 120 therethrough. Thus, when pilot valve 130 and main burner valve 190 are both open, the resulting flow of gas pressurizes a chamber to which gas pressure tap port 210 is connected. When main burner valve 190 is closed, gas pressure tap port 210 and thus diaphragm device 220 are exposed to ambient pressure conditions.

Diaphragm device 220 is a mechanism having an inlet 231, which is alternatively exposed to pressure of the gas or ambient pressure conditions, depending upon the state of main burner valve 190. Diaphragm device 220 also includes a movable member 232, which is a structural component displaced in response to the application of gas pressure to an inlet portion of the device. Moveable member 232 includes a first surface 233 which is exposed to the pressure conditions of the inlet, and a second surface 234 that is exposed to ambient pressure conditions. Accordingly, moveable member 232 is displaced in response to changes in inlet pressure. For example, in some embodiments, moveable member 232 may include a diaphragm, such as a thin, flexible membrane, spanning inlet and ambient conditions.

Moveable member 232 within diaphragm device 220 is operably interconnected with intermediate shaft 235 and damper control activation arm 240, forming a portion of an operable linkage with device 220. When gas pressure is applied to the inlet side of diaphragm device 220, intermediate shaft 235 moves upwards, causing damper control activation arm 240 to pivot about pivot point 250 in the direction of the illustrated arrow 251. When gas pressure is released from diaphragm device 220, intermediate shaft 235 returns to a lowered position and activation arm 240 pivots oppositely to the direction indicated by arrow 251.

Damper control activation arm 240 is illustrated in perspective view in FIG. 3. In the illustrated embodiment, damper control activation arm 240 is made with first arm portion 240*a* and second arm portion 240*b*, which are mechanically connected. One end 252 of damper control activation arm 240 interacts with a switch circuit 260 that includes pilot power control switches 260*a* and 260*b*, which are mounted adjacent to one another.

Figure 4:
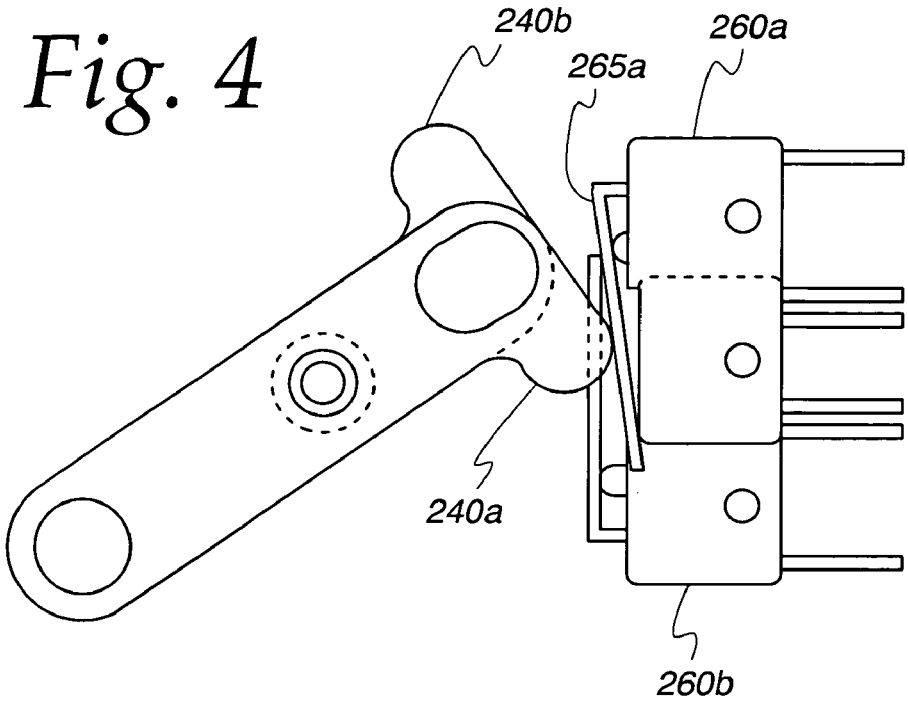
FIG. 4 is an elevation view of a portion of a pilot power control switch, in a position corresponding to an open damper condition.
Figure 5:
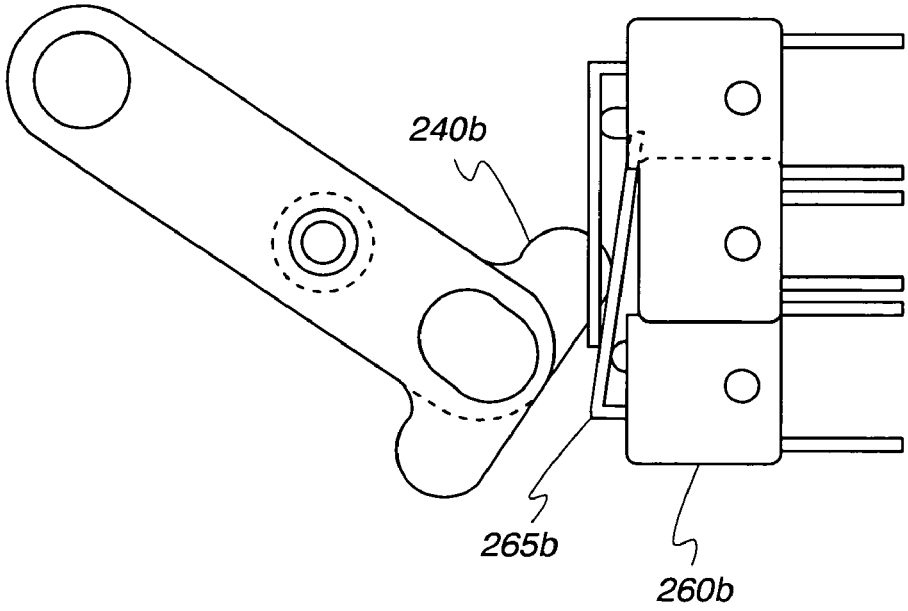
FIG. 5 is an elevation view of a portion of a pilot power control switch, in a position corresponding to a closed damper condition.

Pilot power control switches 260*a* and 260*b* are further illustrated in FIGS. 4 and 5. Pilot power control switches 260*a* and 260*b* include switch arms 265*a* and 265*b*, respectively. Switch arm 265*a* extends downwards from the point at which it is attached to switch 260*a*. Switch arm 265*b* extends upwards from the point at which it is attached to switch 260*b*. Damper control activation arm 240*a* is aligned to interact with pilot power control switch 260*a*, such that switch arm 265*a* is depressed when activation arm 240 is moved to a first position, as shown in FIG. 4, and released when activation arm 240 is moved to a second position, as shown in FIG. 5. Damper control activation arm 240*b* is aligned to interact with pilot power control switch 260*b*, such that switch 265*b* is depressed when activation arm 240 is in the second position, shown in FIG. 5, and released when activation arm 240 is in the first position of FIG. 4. In the exemplary embodiment of FIGS. 4 and 5, the first activation arm position (FIG. 4) is maintained over a range from about 80% to about 100% of the normal range of travel of activation arm 240, in which gas is being supplied to the main burner and the flue damper is substantially open. The second activation arm position (FIG. 5) is maintained over a range from about zero to about 20% of the normal range of travel of activation arm 240, in which the supply of gas to the main burner has been shut off and the flue damper is substantially closed.

Figure 6:
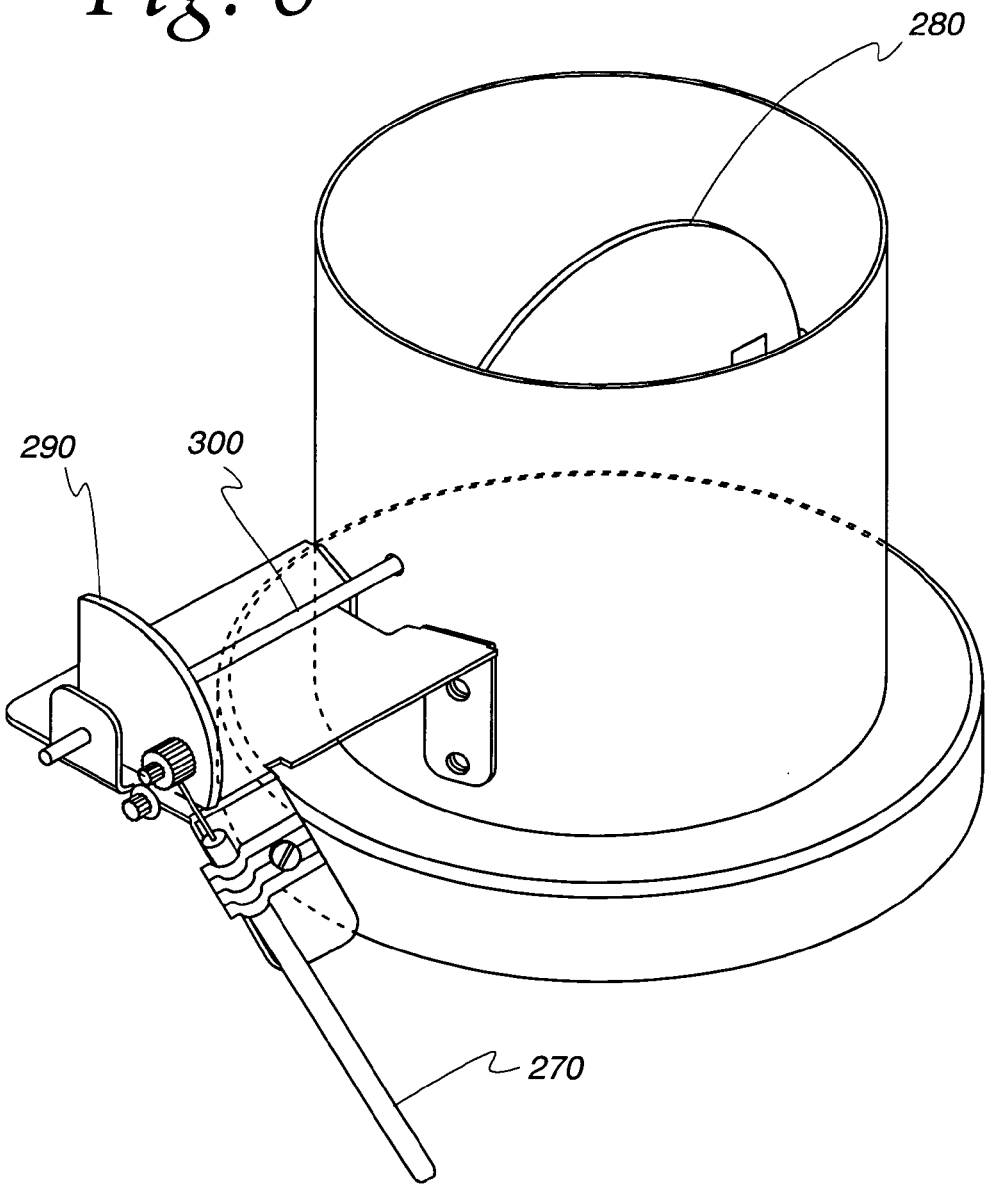
FIG. 6 is a perspective view of a damper.

Damper control activation arm 240 is further connected to link 270, which extends to control the opening and closing of flue damper 280, illustrated in FIG. 6. In an exemplary embodiment, link 270 may incorporate a cable structure, such as a metal cable that slides freely within a polymer sheath. Alternatively, it is understood that other varieties of mechanical links that are known in the art could be implemented, such as a rod or shaft. The end of link 270 opposite damper control activation arm 240 is attached to lever arm 290, which is secured to damper control shaft 300. Damper 280 is mounted on control shaft 300. Accordingly, movement of link 270 results in pivoting of control shaft 300 and damper 280 between open and closed positions.

In operation, when appliance 100 initiates a call for heat, temperature controlled burner valve 190 opens, which permits the flow of pressurized gas to main burner 112, gas pressure tap port 210, tube 230 and diaphragm device 220. The resulting displacement of diaphragm device 220 causes movement of intermediate shaft 235, pivoting of damper control activation arm 240 and movement of link 270, which in turn pivots damper 280 into an open position, so that exhaust is vented while main burner 112 is ignited. When continued activation of main burner 112 is no longer required, temperature controlled burner valve 190 closed, thereby depressurizing gas pressure tap port 210 and diaphragm device 220. Shaft 235 is displaced downwards, which pivots damper control activation arm 240 and moves link 270, which in turn pivots damper 280 into a closed position, so that heat loss from appliance 100 is reduced.

Damper switches 260*a* and 260*b* operate to provide added safety measures in the event that damper 280 becomes stuck in a partially-opened position. In such a position, the flue may be opened sufficiently to permit operation of main burner 112 without tripping a flame safety switch in the burner chamber, but it may not provide enough venting of the flue to eliminate the creation of high levels of carbon monoxide. Accordingly, a further safety feature is provided to address partial opening of the damper.

In the embodiment illustrated in the schematic diagram of FIG. 2, pilot power control switches 260*a* and 260*b* are wired in parallel, between thermoelectric device 160 and pilot magnet 140, such that voltage generated by thermoelectric device 160 is applied to pilot magnet 140 when activation arm 240 is in a raised or lowered position. However, if damper 280 becomes stuck in a partially-opened or partially-closed position, activation arm 240 is likewise placed into an intermediate position, such that neither of switches 260*a* and 260*b* is closed. As a result, power to pilot magnet 140 is interrupted, such that pilot valve 130 is closed and the flow of gas to main burner supply tube 200 and pilot burner supply tube 170 is interrupted, thereby shutting off the main burner 112 and pilot burner 132 and avoiding misoperation that might otherwise be caused by partial closure of damper 280 during firing of main burner 112. Further safety measures can be implemented through the operation of spill switch 302, interposed between damper switches 260*a*, 260*b* and thermoelectric device 140, and flame safety switch 304, interposed in the connection of thermoelectric device 140 to ground. These components interrupt burner operation, thereby to avoid excessive heat generation in the combustion chamber, as may be caused by potentially a number of different conditions.

While the above-described termination of power to pilot valve magnet 140 can avoid undesired operating conditions if damper 280 sticks in a partially-open or partially-closed position, even during the intended operation, damper control activation arms 240 will inherently move momentarily through an intermediate position, in which neither of switches 260*a* and 260*b* is closed, when transitioning normally between elevated and lowered states. In some embodiments, gas pressure tap port 210 will fully pressurize in about 2 to 3 seconds after opening of burner valve 190, during which period damper control activation arm 240 and flue damper 280 are moved between open and closed positions. In order to avoid unintentional closure of pilot valve 130 during this transition period, a lowpass filter or timer circuit is provided between damper switches 260*a* and 260*b*, and pilot magnet 140. In the embodiment of FIG. 2, a series RC circuit with resistor 310 and capacitor 320 is provided. Resistor 310 and capacitor 320 operate to temporarily maintain the voltage level present at pilot magnet 140 when both of switches 260*a* and 260*b* are opened.

Capacitor 320 can be sized to accommodate the target switching time, voltage levels and circuit resistance. For example, in an embodiment utilizing a thermocouple having a nominal minimum operating voltage of 10 millivolts and a circuit resistance of 0.017 Ohms, and requiring at least 5 millivolts applied to pilot magnet 140 to maintain pilot valve 130 in an open position, it can be determined that a 220 Farad capacitor would maintain the required voltage level for around 2.6 seconds. In embodiments utilizing a thermopile in place of a thermocouple, the higher operating voltages would allow for a smaller capacitor to maintain the required pilot magnet voltage for a given period of time.

The foregoing description and drawings merely explain and illustrate the invention and the invention is not limited thereto, inasmuch as those skilled in the art, having the present disclosure before them will be able to make modifications and variations therein without departing from the scope of the invention.

What is claimed is:

1. A gas-fired appliance comprising:

a burner, configured to receive and burn pressurized gas during operation;

a diaphragm device having an inlet exposed to pressure from the pressurized gas during operation of the burner, and a movable member which moves in response to the application of pressurized gas at the inlet;

a linkage which moves in response to movement of the movable member;

a damper assembly connected to the linkage, the damper assembly comprising a damper movable between an open position and a closed position in response to movement of the linkage, the burner receiving pressurized gas with the damper in a partially-opened position between the open and closed position; and a switch circuit responsive to movement of the linkage and causing interruption of flow of pressurized gas to the burner in the event that the damper remains in the partially-opened position between the open and closed positions for at least a predetermined time period.

2. The gas-fired appliance of claim 1, further comprising:

a pilot burner;

a thermoelectric device positioned near the pilot burner which generates electrical voltage when exposed to heat from the pilot burner; and a magnetic pilot valve having an electrical input, which valve is maintained in an open position in response to maintenance of the electrical voltage at the pilot valve electrical input, wherein the switch circuit is interposed into an electrical conduction path between the thermoelectric device and the magnetic pilot valve electrical input, the switch circuit being movable between an open state and a closed state in response to movement of the linkage.

3. The gas-fired appliance of claim 2, in which the linkage comprises a damper control activation arm, which pivots between a first position and a second position in response to movement of the linkage; and the switch circuit is comprised of:

a first switch which is closed by the damper control activation arm when the damper control activation arm is in the first position; and a second switch, connected electrically in parallel with the first switch, which is closed by the damper control activation arm when the damper control activation arm is in a second position.

4. A gas-fired appliance comprising:

a burner, configured to receive and burn pressurized gas during operation;

a diaphragm device having an inlet exposed to pressure from the pressurized gas during operation of the burner, and a movable member which moves in response to the application of pressurized gas at the inlet;

a linkage which moves in response to movement of the movable member;

a damper assembly connected to the linkage, the damper assembly comprising a damper movable between an open position and a closed position in response to movement of the linkage;

a pilot burner;

a thermoelectric device positioned near the pilot burner which generates electrical voltage when exposed to heat from the pilot burner;

a magnetic pilot valve having an electrical input, which valve is maintained in an open position in response to maintenance of the electrical voltage at the pilot valve electrical input;

a switch circuit interposed into an electrical conduction path between the thermoelectric device and the magnetic pilot valve electrical input, the switch circuit being movable between an open state and a closed state in response to movement of the linkage, wherein the linkage comprises a damper control activation arm, which pivots between a first position and a second position in response to movement of the linkage;

wherein the switch circuit comprises:

a first switch which is closed by the damper control activation arm when the damper control activation arm is in the first position; and a second switch, connected electrically in parallel with the first switch, which is closed by the damper control activation arm when the damper control activation arm is in a second position; and a resistor and a capacitor operably interconnected, the capacitor being connected between a signal path leading to the pilot valve electrical input and a ground reference voltage, whereby the capacitor charges when the switch circuit is in the closed state, and discharges when the switch circuit is in the open state.

5. A gas-fired appliance comprising:

a burner, configured to receive and burn pressurized gas during operation;

a diaphragm device having an inlet exposed to pressure from the pressurized gas during operation of the burner, and a movable member which moves in response to the application of pressurized gas at the inlet;

a linkage which moves in response to movement of the movable member;

a damper assembly connected to the linkage, the damper assembly comprising a damper movable between an open position and a closed position in response to movement of the linkage;

a pilot burner;

a thermoelectric device positioned near the pilot burner which generates electrical voltage when exposed to heat from the pilot burner;

a magnetic pilot valve having an electrical input, which valve is maintained in an open position in response to maintenance of the electrical voltage at the pilot valve electrical input; and a switch circuit interposed into an electrical conduction path between the thermoelectric device and the magnetic pilot valve electrical input, the switch circuit being movable between an open state and a closed state in response to movement of the linkage, wherein the linkage comprises a damper control activation arm, which pivots between a first position and a second position in response to movement of the linkage, wherein the switch circuit comprises:

a first switch which is closed by the damper control activation arm when the damper control activation arm is in the first position; and a second switch, connected electrically in parallel with the first switch, which is closed by the damper control activation arm when the damper control activation arm is in a second position, wherein the damper control activation arm is comprised of a first arm portion which depresses a contact on the first switch when the damper control activation arm is in the first position, and a second arm portion which depresses a contact on the second switch when the damper control activation arm is in the second position.

6. A gas-fired appliance comprising:

a burner, configured to receive and burn pressurized gas during operation;

a diaphragm device having an inlet exposed to pressure from the pressurized gas during operation of the burner, and a movable member which moves in response to the application of pressurized gas at the inlet;

a linkage which moves in response to movement of the movable member;

a damper assembly connected to the linkage, the damper assembly comprising a damper movable between an open position and a closed position in response to movement of the linkage;

a pilot burner;

a thermoelectric device positioned near the pilot burner which generates electrical voltage when exposed to heat from the pilot burner;

a magnetic pilot valve having an electrical input, which valve is maintained in an open position in response to maintenance of the electrical voltage at the pilot valve electrical input; and a switch circuit interposed into an electrical conduction path between the thermoelectric device and the magnetic pilot valve electrical input, the switch circuit being movable between an open state and a closed state in response to movement of the linkage, wherein the linkage comprises a damper control activation arm, which pivots between a first position and a second position in response to movement of the linkage, wherein the switch circuit comprises:

a first switch which is closed by the damper control activation arm when the damper control activation arm is in the first position; and a second switch, connected electrically in parallel with the first switch, which is closed by the damper control activation arm when the damper control activation arm is in a second position, wherein the linkage moves within a predetermined range of motion, wherein the first position comprises a range from zero to about 20 percent of the predetermined range of motion, and wherein the second position comprises a range from about 80 percent to 100 percent of the predetermined range of motion.

7. The gas-fired appliance of claim 1, in which the linkage comprises a cable sliding within a stationary sheath.

8. The gas-fired appliance of claim 1, in which the linkage comprises a shaft.

9. The gas-fired appliance of claim 1, in which the damper assembly further comprises a pivoting damper shaft on which the damper is mounted, and a lever arm secured to the pivoting damper shaft at a first location and secured to the linkage at a second location.

10. A damper control mechanism for an appliance that operates through combustion of gas having a pressure that is greater than ambient pressure, the damper control mechanism comprising:

a damper having closed and open positions;

a burner, configured to receive and burn pressurized gas during operation, the burner receiving pressurized gas with the damper in a partially-opened position between the open and closed positions;

a pilot burner that burns gas during operation;

a diaphragm device having an inlet that is exposed to the gas pressure during operation of the appliance, and a movable diaphragm having a first side and a second side, which movable diaphragm is exposed to pressure conditions of the inlet on the first side and ambient pressure conditions on the second side, such that the movable diaphragm is configured to move in response to change of the pressure at the inlet, whereby the movable diaphragm is arranged to occupy a first position when the inlet is under ambient pressure and a second position when the inlet is exposed to the gas pressure;

a linkage, operably connected to the diaphragm device and to the damper, whereby the linkage imparts movement on the damper in response to movement of the movable diaphragm; and a switch circuit responsive to movement of the linkage and causing interruption of flow of gas to at least one of the burner and pilot burner in the event that the damper remains in the partially-opened position between the open and closed positions for at least a predetermined time period.

11. The damper control mechanism of claim 10, in which the linkage comprises a cable sliding within an outer sheath.

12. The damper control mechanism of claim 10, in which the linkage comprises a shaft.

13. A damper control mechanism for an appliance that operates through combustion of gas having a pressure that is greater than ambient pressure, the damper control mechanism comprising:

a diaphragm device having an inlet that is exposed to the gas pressure during operation of the appliance, and a movable diaphragm having a first side and a second side, which movable diaphragm is exposed to pressure conditions of the inlet on the first side and ambient pressure conditions on the second side, such that the movable diaphragm is configured to move in response to change of the pressure at the inlet, whereby the movable diaphragm is arranged to occupy a first position when the inlet is under ambient pressure and a second position when the inlet is exposed to the gas pressure;

a linkage, operably connected to the diaphragm device and to the damper, whereby the linkage imparts movement on the damper in response to movement of the movable diaphragm;

a thermoelectric device having an output capable of generating an electrical voltage differential; and a circuit comprising one or more electrical switches, which circuit electrically connects the thermoelectric device and a magnet pilot valve and, wherein the linkage contacts the one or more electrical switches to disconnect the thermoelectric device from the magnetic pilot valve when the movable diaphragm is not within either the first or the second position.

14. The control mechanism of claim 13, in which the circuit further comprises a capacitor having a first terminal operably connected with the thermoelectric device and the magnetic pilot valve, and a second terminal connected to a ground reference voltage, whereby the capacitor can temporarily provide electrical energy to the magnetic pilot valve when the circuit opens the connection between the magnetic pilot valve and the thermoelectric device.

15. The control mechanism of claim 13, in which the linkage comprises an arm attached to a pivot such that the arm pivots between a first position and a second position during movement of the linkage; and the arm being further mounted proximate the one or more electrical switches, whereby the arm contacts the one or more switches to change their state during movement of said arm.

16. A method for controlling a damper in a gas-fired appliance, comprising the steps of:

applying pressurized gas to a first portion of the gas-fired appliance which includes a main burner;

changing a damper from a closed position into an open position by moving a linkage connected to the damper via an application of mechanical force generated by the introduction of pressurized gas into the first portion of the gas-fired appliance, the main burner receiving pressurized gas with the damper in a partially-opened position between the open and closed positions; and interrupting flow of the pressurized gas to the main burner in the event that the damper remains in the partially-opened position between the open and closed positions for at least a predetermined time period.

17. The method of claim 16 in which:

the step of applying pressurized gas to a first portion of the gas-fired appliance comprises the step of applying pressurized gas to a diaphragm device to cause movement of said diaphragm device; and the step of opening a damper by moving a linkage comprises the step of moving the linkage in response to said movement of said diaphragm device.

18. A method for controlling a damper in a gas-fired appliance, comprising the steps of:

applying pressurized gas to a first portion of the gas-fired appliance which includes a main burner; and opening a damper by moving a linkage connected to the damper via an application of mechanical force generated by the introduction of pressurized gas into the first portion of the gas-fired appliance, wherein the step of opening a damper via movement of a linkage comprises the steps of:

providing a magnetic pilot valve which maintains an open position in response to the maintenance of an electrical signal at an input terminal;

applying the electrical signal to the magnetic pilot valve input terminal when the damper is in an open or closed position; and removing the electrical signal from the magnetic pilot valve input terminal when the damper occupies a partially-opened position with pressurized gas being supplied to the main burner for at least a predetermined period of time.

19. The method of claim 18, in which the predetermined period of time is at least about 2 seconds.

20. The method of claim 18, in which the predetermined period of time is between about two seconds to about three seconds.

21. The damper control mechanism of claim 10 wherein the switch circuit causes interruption of flow of gas to each of the burner and pilot burner in the event that the damper remains between the open and closed positions for at least the predetermined time period.

* * * * *